US006204832B1

(12) United States Patent
Melville et al.

(10) Patent No.: US 6,204,832 B1
(45) Date of Patent: Mar. 20, 2001

(54) IMAGE DISPLAY WITH LENS ARRAY SCANNING RELATIVE TO LIGHT SOURCE ARRAY

(75) Inventors: Charles D. Melville, Issaquah; Michael Tidwell, Seattle; Richard S. Johnston, Issaquah, all of WA (US)

(73) Assignee: University of Washington, Seattle, WA (US)

( * ) Notice: Subject to any disclaimer, the term of this patent is extended or adjusted under 35 U.S.C. 154(b) by 0 days.

(21) Appl. No.: 09/072,012

(22) Filed: May 4, 1998

Related U.S. Application Data

(60) Provisional application No. 60/045,839, filed on May 7, 1997.

(51) Int. Cl.[7] ..... G09G 3/20

(52) U.S. Cl. ..... 345/55; 345/32; 345/82; 345/31; 340/815.42; 340/815.45; 340/815.54; 340/815.68

(58) Field of Search ..... 345/55, 32, 33, 345/31, 82, 83, 86; 340/815.42, 815.45, 815.54, 815.68

(56) References Cited

U.S. PATENT DOCUMENTS

| | | | |
|---|---|---|---|
| 5,467,104 | 11/1995 | Furness, III et al. | 345/55 |
| 5,557,444 | 9/1996 | Melville et al. | 345/31 |
| 5,587,836 | 12/1996 | Takahashi et al. | 345/55 |
| 5,596,339 | 1/1997 | Furness, III et al. | 345/55 |
| 5,694,237 * | 12/1997 | Melville | 345/55 |
| 5,701,132 | 12/1997 | Kollin et al. | 345/31 |
| 5,815,314 * | 10/1999 | Sudo | 345/31 |
| 5,969,871 * | 10/1999 | Tidwell et al. | 345/55 |
| 6,008,781 * | 12/1999 | Furness, III et al. | 345/55 |

OTHER PUBLICATIONS

"Refractive Microlens Arrays," MEMS Optical, Inc., Huntsville, Alabama, 1998.

* cited by examiner

*Primary Examiner*—Richard A. Hjerpe
*Assistant Examiner*—Ali A. Zamani
(74) *Attorney, Agent, or Firm*—Steven P. Koda

(57) ABSTRACT

A point source array generates an array of output beams defining a plurality of image pixels. A microlens array receives the output beams and direct them toward desired pixel locations. Either one or both of the point source array and microlens array are scanned over time to form an image of pixels. An image is composed of an array of image portions. Each image portion includes a plurality of pixels. For each image portion, there is a corresponding point source of light and a corresponding microlens. The corresponding point source and microlens scan light within the area of the image portion to generate all of the pixels for such image portion. The microlens array is an integral array. Each lens moves together with each image portion being scanned concurrently by the microlens array an point source array.

24 Claims, 8 Drawing Sheets

FIG.2
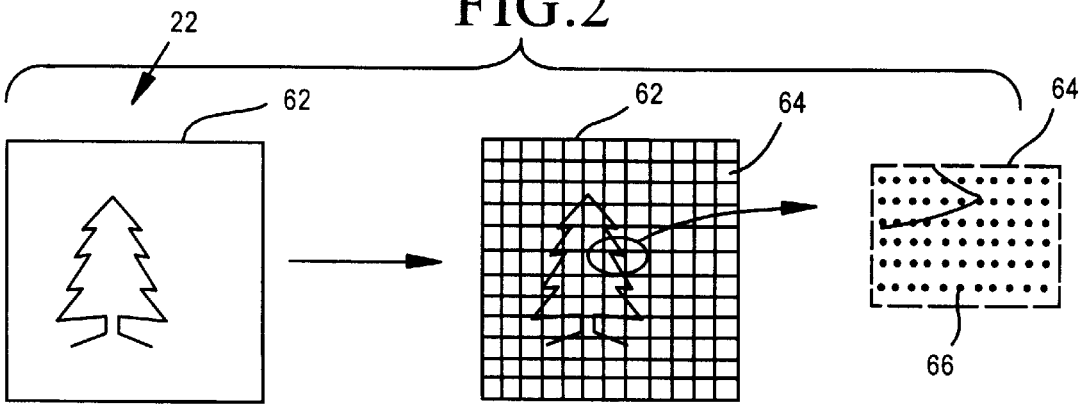
FIG.3
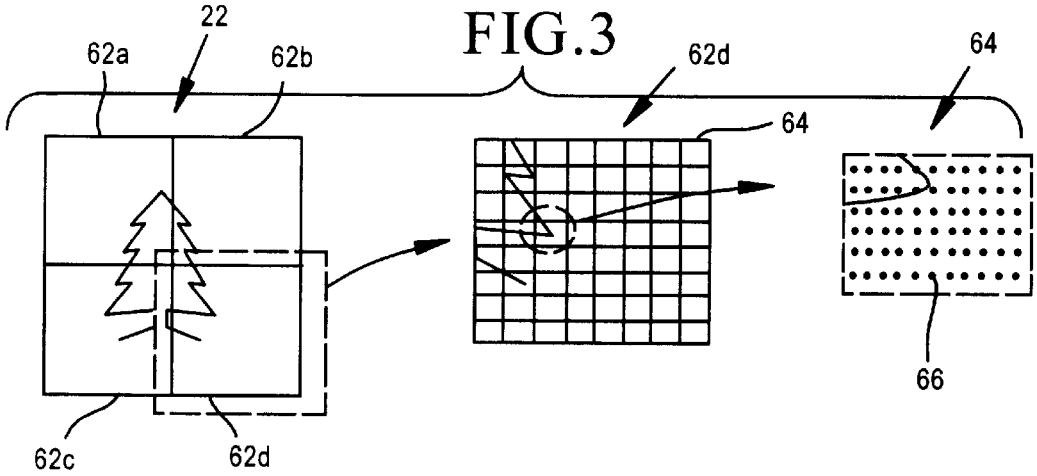
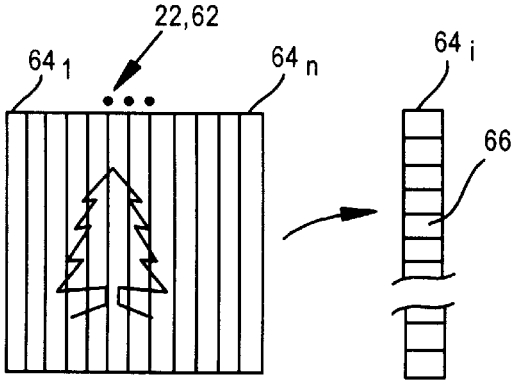
FIG.4
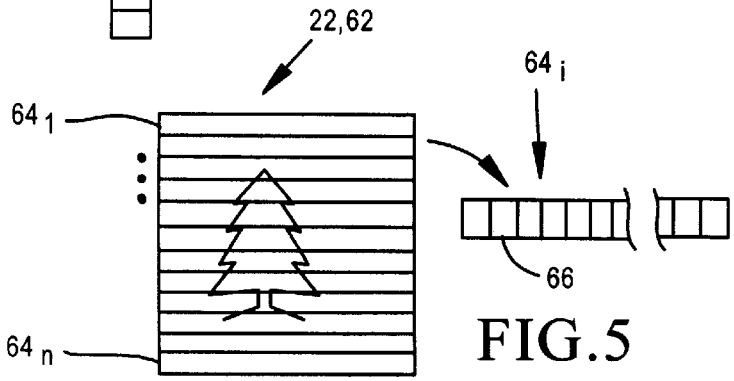
FIG.5

IMAGE DISPLAY WITH LENS ARRAY SCANNING RELATIVE TO LIGHT SOURCE ARRAY

CROSS REFERENCE TO RELATED APPLICATIONS

This invention is related to U.S. Provisional Patent Application Serial No. 60/045,839 filed May 7, 1997 for Lens Array Display and Method for Scanning Same.

BACKGROUND OF THE INVENTION

This invention relates to scanning display methods and apparatus, and more particularly to a scanning display including an array of optical elements, such as microlenses.

Small, light weight displays are desirable for use in portable devices such as cellular phones, pagers, handheld computers and helmet-mounted displays. One challenge to implementing a small lightweight display is the typically poorer resolution achieved relative to that of a full size computer screen display. A scanned beam display such as the virtual retinal display disclosed in U.S. Pat. No. 5,467,104 to Furness et al, which is incorporated herein by reference, is able to achieve improved resolution while being of a relatively small volume.

A scanned retinal display device is an optical device that produces a preceived image by scanning a modulated beam of light onto the retina of an eye. In one such device, light is emitted from a light source, passed through a lens, then deflected along a scan path by a scanning device. At a distance defined by the lens, the scanned light converges to a focal point for each pixel position. As the scanning occurs the focal point moves to define an intermediate image plane. The light then diverges beyond the plane. An eyepiece typically is positioned along the light path beyond the intermediate image plane at some appropriate position. The eyepiece receives light that is being deflected along a raster pattern and redirects the beam to define an "exit pupil." The exit pupil occurs shortly beyond the eyepiece in an area where a viewer's eye pupil is to be positioned. When a viewer looks into the eyepiece to view an image, the viewer's eye pupil receives the light at differing angles at different times during the scanning cycle. This range of angles determines the size of the image perceived by the viewer. Modulation of the light during the scanning cycle determines the content of the image.

The scanned retinal display typically places significant demands upon the scanning system, in terms of field of view, speed of the scanning mirror, size, temperature dependence, and a variety of other performance and design parameters. Often, scanned beam systems meet these demands with scanned mirrors that move at high angular rates. While scanned mirror display systems can perform well, it is sometimes desirable to develop alternative approaches to producing displays using scanned beams, particularly in light weight, small volume displays. As disclosed herein, an approach to producing such an image includes display that generates an image upon a screen or viewer's eye using a microlens array and a light source array.

SUMMARY OF THE INVENTION

According to one embodiment of the invention, an array of light emitters, such as a point source array, generates an array of output beams defining a plurality of image pixels. An array of optical elements, such as microlenses, receives the output beams and directs them toward desired pixel locations. Either one or both of the emitter array and the microlens array are scanned over time to form an image of pixels.

According to one aspect of the invention, an image or a subsection of an image is composed of an array of image portions. Each image portion includes a plurality of pixels. For each image portion, there is a corresponding point source of light within the point source array and a corresponding microlens within a microlens array. The corresponding point source and microlens scan within a given image portion to generate all of the pixels within that image portion. Each point source within the point source array is fixed relative to each of the other point sources within the point source array. Similarly, each of the microlenses is fixed relative to the other microlenses within the microlens array. Thus, as one microlens is scanned relative to its corresponding point source to generate the multiple pixels within one image portion, the other microlenses, concurrently, are being scanned relative to the other point sources to generate the multiple pixels within each of the other image portions. Each of the point source-microlens combinations completes the scan of its corresponding image portion at the same time. Upon completion, the image or image subsection has been completely scanned, allowing a viewer to perceive the image or image subsection. In the case of completion of an image scan, an image frame has been completed. A new image frame then may be scanned. In the case of completion of an image subsection, the entire point source array-microlens array combination then can be repositioned to scan another image subsection. When all image subsections have been scanned an image frame is complete. A new frame may then commence.

According to various applications, either or both of the point source array and the microlens array may be a one-dimensional array or a two dimensional. For full image scanning with one dimensional arrays, one element of each array corresponds to each pixel in a line of an image (e.g., a horizontal line or a vertical line). For example, for a microlens-point source combination where each microlens-point source pair corresponds to a pixel in a vertical line of an image, the microlens-point source combination produces a vertical line of image pixels simultaneously. Scanning the microlens array relative to the point source array scans the vertical line of output beams horizontally to scan the image. Alternatively, such a scan may be for only an image subsection. The arrays then are repositioned to scan another image subsection.

For full image scanning with two dimensional arrays, one microlens-point source combination corresponds to each image portion of the full image. The microlens array is scanned relative to the point source array in either one dimension or two dimensions to generate all of the pixels within each image portion. For full image subsection scanning with two dimensional arrays one microlens-point source combination corresponds to each image portion of the image subsection. The microlens array scans relative to the point source array in either one dimension or two dimensions to generate all of the pixels within each image portion of the image subsection.

According to another aspect of this invention, a drive circuit moves the microlens array along one or two drive axes. In one embodiment, the drive circuit includes electromagnetic coils that move a plate in which the lenses are integrally formed. In another embodiment, the drive circuit includes piezoelectric volumes which deform to deflect plate in which the lenses are integrally formed.

Alternatively, the point source array is moved rather than the microlens array. One set of piezoelectric volumes moves the array along one axis for scanning in a first direction. Another set of piezoelectric volumes is included in some embodiments to move the array along another axis for scanning in a second direction.

According to another aspect of this invention, a second array of microlenses is included in some embodiments for two dimensional scanning of the output beams. One microlens array is moved along one scanning axis. The other microlens array is moved along the other scanning axis. Drive circuits are included to move the respective microlens arrays.

According to another aspect of the invention, a display apparatus presents an image including a plurality of image portions. Each one of the plurality of image portions includes a plurality of image pixels. A plurality of light emitters are operative with each one light emitter emitting a beam of light in response to an input signal. Each one microlens of a corresponding plurality of microlenses receives a beam of light from its corresponding light emitter. Each one microlens, the corresponding light emitter and the corresponding emitted, received and passed beam of light together correspond to one image portion of the image. The microlens array is movable through a plurality of positions relative to the plurality of light emitters to scan each beam of light through each image pixel within each corresponding image portion. A positioner moves the microlens array relative to the plurality of light emitters in a predetermined pattern to scan the corresponding passed beams of light through the image pixel locations.

According to another aspect of the invention, the apparatus displays the image in response to an image signal. Each light source of the array of light sources is responsive to a respective drive signal to provide a modulated light beam corresponding to the drive signal. The positioner is responsive to a periodic scan signal to move the microlens array through a periodic scan pattern substantially transverse to the light beams. An electronic controller electrically coupled to the array of light sources provides the respective drive signals in response to the image signal. The electronic controller also is electrically coupled to the positioner and operative to produce the periodic scan signal.

According to another aspect of the invention, a method for scanning the image, includes emitting a plurality of beams of light from a plurality of first locations, in which the plurality of first locations are arranged in a first array. The plurality of beams of light are received at the array of microlenses. Each one microlens passes the received beam of light to generate an image pixel of a corresponding image portion. The microlens array moves relative to the first array causing the passed beam of light to be scanned to generate other image pixels of each corresponding image portion.

An advantage of the invention is that many pixels are generated concurrently. This allows more time of the frame period to be used in moving the light beams. Another advantage is that a compact light weight display apparatus is achieved. These and other aspects and advantages of the invention will be better understood by reference to the following detailed description taken in conjunction with the accompanying drawings.

BRIEF DESCRIPTION OF THE DRAWINGS

FIG. 2 is a diagrammatic view of a display field formed of one image section as generated with the system of FIG. 1, in which the image section includes multiple image portions, each image portion formed of multiple image pixels;

FIG. 3 is a diagrammatic view of a display field formed of multiple image subsections as generated with the system of FIG. 1, in which each image subsection includes multiple image portions, each image portion formed of multiple image pixels;

FIG. 4 is a diagrammatic view of an image having a plurality of vertical image portions, each image portion formed of a column of pixels;

FIG. 5 is a diagrammatic view of an image having a plurality of horizontal image portions, each image portion formed of a row of pixels;

DESCRIPTION OF SPECIFIC EMBODIMENTS

Display System

Figure 1:
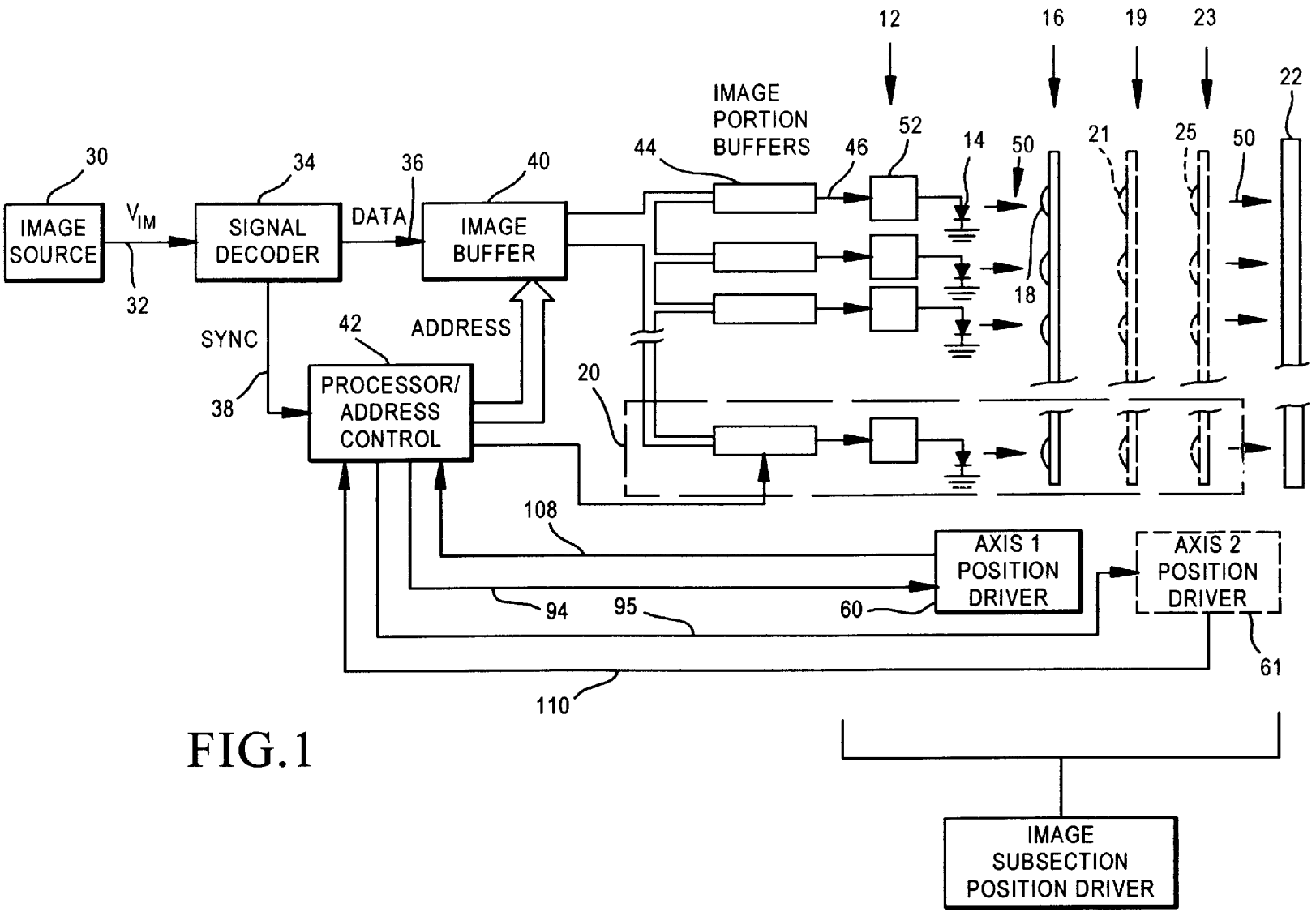
FIG. 1 is a block diagram of a display system according to an embodiment of this invention.

Referring to FIG. 1, a display system 10 includes an array 12 of light emitters 14 and an integral array 16 of microlenses 18 according to an embodiment of this invention. There is a one to one correspondence between the light emitter array 12 and the microlens array 16. The array 12 of light emitters 14 may be formed in a variety of manners. For example, the array may be an array of organic light emitting diodes, an array of discrete laser or light emitting diodes, an matrix addressible array, such as a field emission display, or an output of an optical fiber bundle driven by modulated light sources. The microlens array is an an integral refractive microlens array formed of fused silica lenses, such as those available from Mems Optical, Inc. of Huntsville, Ala.

An image source 30 generates an image signal 32 that defines image content and display synchronization. The image signal 32 may be an RGB signal, NTSC signal, VGA signal, SVGA signal, or other formatted color or monochrome video or image data signal. The image signal 32 typically is time allocated into sequential image frames. Each frame is displayed within a requisite time period. Frame rates of 60 Hz and 72 Hz are common for enabling a human eye to perceive a nonflickering image. A signal decoder 34 receives the image signal 32 and extracts image data 36 and image synchronization information 38. Typically, the data 36 is a series of image pixel defining values. For a color display, the data for one pixel set may define the red green and blue pixel components. For purposes herein, a pixel may a color component pixel (e.g., a red pixel, a green pixel, or a blue pixel or a combined pixel formed from red, green and/or blue components). The synchronization information 38 is extracted to define scanning synchronization signals for controlling the timing/addressing of when a given data item within the data stream 36 is to be displayed. The data 36 is stored in an image buffer 40. The synchronization information 38 is processed by an address control processor 42. The image data is output from the image buffer 40 into appropriate image portion buffers 44 under the control of the processor 42.

A respective, serial stream of data 46 is output from each image portion buffer 44 to define the optical state of a corresponding output beam 50. In one embodiment, each serial stream of data 46 is output to a corresponding driver 52 of a light emitter 14. The binary data define the optical output level of the corresponding light emitter 14, according to known digital-to-analog conversion techniques. In an alternative embodiment each light emitter is maintained in an on state, but its output beam is blocked or passed for a period determined by the binary data. Each set of data received in sequence corresponds to an optical state for a pixel defined by the output beam 50.

In a preferred embodiment, the serial streams of data 46 are synchronously fed from each image portion buffer 44 to the respective light emitter drivers 52. Thus, at any given time there is a light beam 50 (e.g., in an optical state corresponding to the data) output from each light emitter 14, and in turn there is a pixel imaged for each light emitter 14. Each light beam 50 is received at a corresponding microlens 18. For each light emitter 14—microlens 18 pair, there also is a corresponding image portion buffer 44, a serial data stream 46, a driver 52 and a light beam 50. Each set of a corresponding light emitter 14, microlens 18, image portion buffer 44, serial data stream 46, driver 52 and light beam 50 form an optical channel 20. Thus, each image portion buffer 44 feeds a serial stream 46 of image data to a driver 52 which modulates a respective light emitter 14 to output a respective light beam 50 toward a respective microlens 18. The microlens 18 receives and passes the light beam 50 toward a display field 22 to define an image pixel.

As the optical channel 20 outputs the beam 50, a mechanical positioner 60 moves the microlens array 16 relative to the light emitter array 12 synchronously with the serial image data streams 46. More specifically, the positioner 60 moves the microlens array 16 relative to the light emitter array 12 to concurrently scan the respective light beams 50. Each optical channel 22 thus defines an image portion within the display field 22. For example, a 500 optical channel display system may have up to 500 image portions concurrently scanned. If the array 12 moves to 700 discrete positions during an image frame, each image portion will have 700 discrete pixels. Such a system would produce 35,000 pixels (500×700) during each frame. One skilled in the art will recognize that the geometry of the image will depend upon the layout of the arrays 12, 16 and the geometry of the scanning pattern.

In one embodiment, the positioner 60 moves the array 16 or the array 12 to scan the light beams 50 along a single scanning axis. In another embodiment, the positioner 60 produces scanning along two scanning axes by moving the microlens array 16 or the light emitter array 12 along each scanning axis.. In the preferred embodiment, the positioner 60 scans the light beams 50 by moving the microlens array 16 relative to the light emitter array 12. However, in alternative embodiments, the light emitter array 12 may be moved instead. In other embodiment, another integral array 19 of microlenses 21 is included. There is a one to one correspondence between the microlenses 21 and the microlenses 18. Thus, each optical channel 20 includes one of the microlenses 21 in addition to the previously described components. A positioner 60 scans the light beams 50 along one axis by moving the microlens array 16 relative to the light emitter array 12. Another positioner 61 scans the light beams 50 along a second axis by moving the microlens array 21 relative to the light emitter array 12 and the first microlens array 16. Accordingly, each light beam 50 is scanned along either one axis or two axes to define a corresponding group of pixels within each respective image portion.

In some embodiments there is still another positioner 58 which repositions the light emitter array 12 and microlens array(s) 16/21 to provide another division of the image frame. The positioner 58 moves the arrays 12, 16 to divide the display field 22 into image subsections 62 (see FIG. 3), while the positioner 60 moves the array 16 relative to the array 12 to divide each subsection 62 into image portions 64.

For a retinal scanning display embodiment, another array 23 of lenses 25 is positioned between the microlens array 16 and the display field 22. Such other array 23 serves as an eyelens.

The light emitter array 12 is formed by a plurality of point or collimated beam sources which generate respective light beams 50. Each light beam 50 may be a coherent or non-coherent beam of light. Preferably, each beam is emitted along an optical axis parallel to those of the other beams of light. In one embodiment each emitter 14 is at a fixed position relative to each other emitter in the array 12. The emitters 14 are formed in various embodiments by light emitting diodes, organic light emitters or lasers.

Image Divisions and Pixel Scanning

Referring to FIG. 2, the display field 22 encompasses an area for projecting an image. Such display field 22 is projected onto a screen or onto a retina of a viewer's eye. An image 23 is presented within the display field 22 by scanning the multiple light beams 50 along prescribed scan paths. The image 23 is formed by one or more image subsections 62. Each image subsection 62 is, in turn, formed by a plurality of image portions 64 and each image portion 64 is formed by a plurality of image pixels 66. FIG. 2 shows a display field 22 with one image subsection 62. FIG. 3 shows a display field 22 with multiple image subsections 62. As can be seen in FIG. 3, each image subsection 62 can include a plurality of image portions 64, which in turn are formed of a plurality of pixels 66. In the preferred embodiment, each image portion 64 includes the same number of image pixels 66.

The image portions 64 may be allocated from the image subsection 62 into a two dimensional array of image portions 64 as shown in FIGS. 2 and 3, or into a one dimensional array of image portions 64 as shown in FIGS. 4 and 5. FIG. 4 shows an array of vertical image portions 64. FIG. 5 shows an array of horizontal image portions 64. Each image portion 64 of FIG. 4 includes the same number and arrangement of image pixels 66 as the other image portions of FIG. 4. Similarly, each image portion 64 of FIG. 5 includes the same number and arrangement of image pixels 66 as the other image portions 64 of FIG. 5. One skilled in the art will recognize that a wide range of combinations of image portions 62 can be used to fill all or a part of the display field 22.

Referring again to FIG. 2, there are 108 image portions 64 depicted. Such number of course may vary. Each image portion 64 corresponds to one of the optical channels 20.

Thus, at any given time during an image frame, one pixel is being displayed from each of the image portions 64. The relative position of such one pixel within each image portion 64 is typically the same. Further, because the position of each microlens 18 is fixed relative to the other microlenses in the microlens array 18, and because the position of each light emitter 14 is fixed relative to the other light emitters within the light emitter array 12, the relative scan path within any given image portion 64 is the same. FIG. 2, for example, depicts an array of image portions 64. Each image portion is formed by multiple rows and columns of pixels 66. As will be described below with reference to FIGS. 6*a–c,* each optical channel 20 scans one horizontal line of pixels 66, then moves down vertically to scan another horizontal line of pixels. This continues until all pixels within the image portion are scanned. Accordingly, two dimensional scanning is performed. Even though the array of image portions in FIG. 2 is two dimensional, two dimensional scanning also may be performed for a one dimensional array of image portions. For such an array each image portion would be formed by a two dimensional array of image pixels.

Figure 6A:
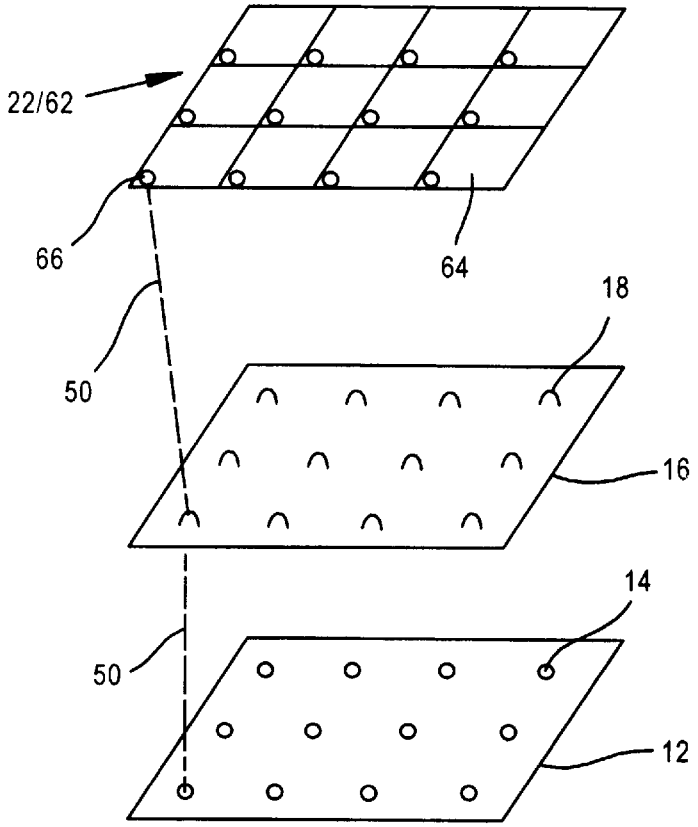
FIGS. 6*a*–6*c* are diagrams of the positional relationship between the emitter array and microlens array of FIG. 1 at different times during an image portion scanning period.
Figure 6B:
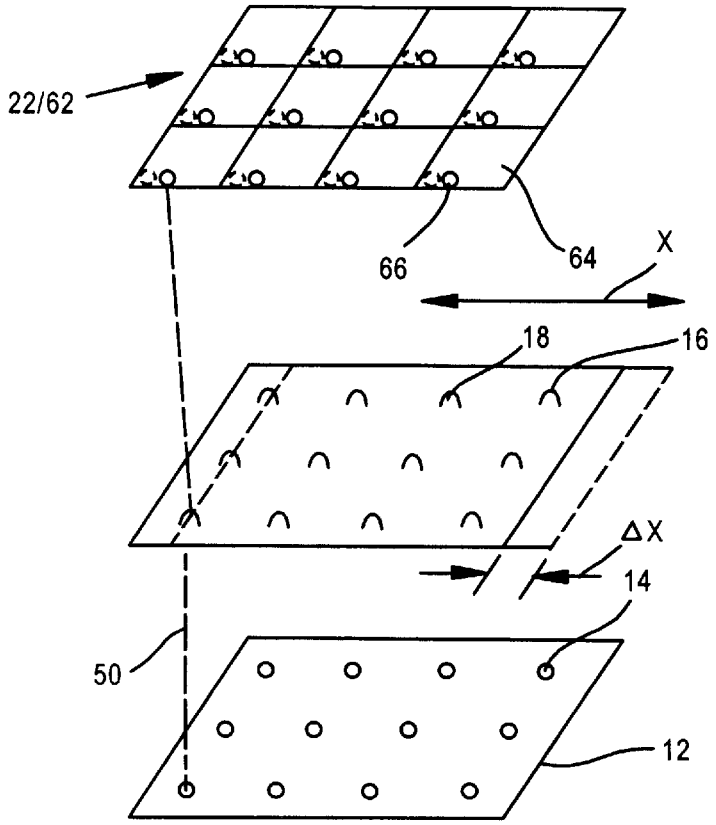
Figure 6C:
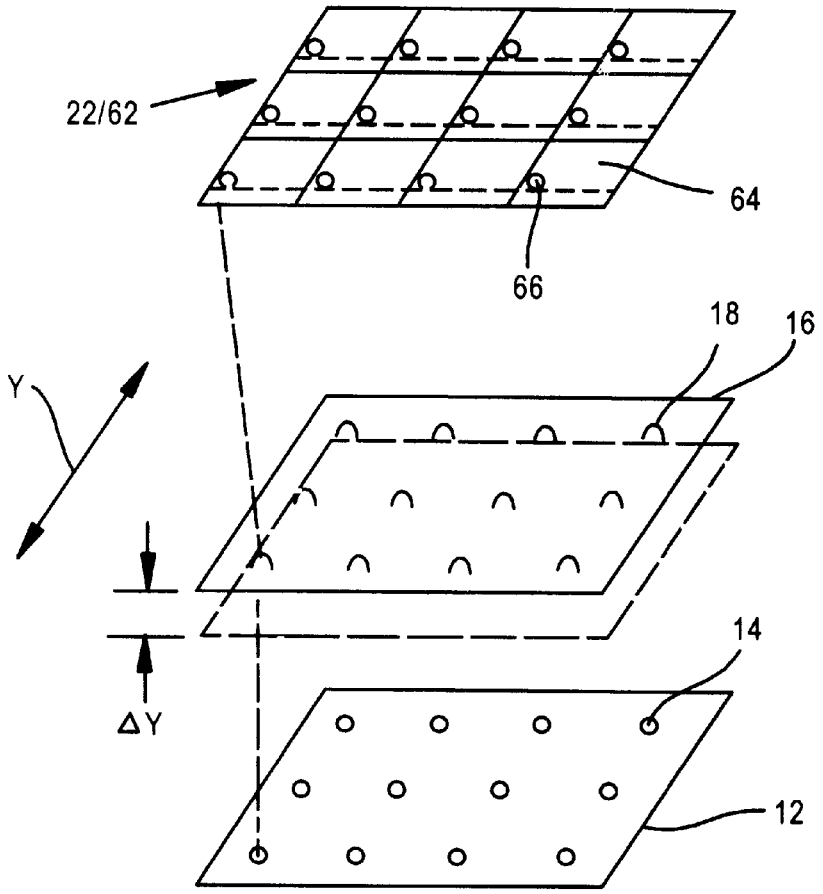

Referring now to FIG. 6*a,* an initial position is shown for imaging a first pixel 66 in each image portion 64. A respective light beam 50 is output from each light emitter 14 toward a corresponding microlens 18. The light beam 50 passes through the microlens toward the display field 22 in the current image subsection 62 being scanned. A pixel 66 in each image portion 64 of the image subsection 62 is concurrently scanned. FIG. 6*b* shows the relative position of the microlens array 18 relative to the light emitter array 12 a short time later when an adjacent pixel is being imaged in each image portion. Note that the microlens array has moved along a first axis x by an increment Dx to position the output beams 50 at the adjacent pixel area within each image portion 64. FIG. 6*c* shows the relative position of the microlens array 18 relative to the light emitter array 12 at a later time in the image portion scan cycle when another row of pixels is to be imaged. Note that the microlens array has moved along a second axis y by an increment Dy to position the output beams 50 at the adjacent row within each image portion 64.

According to an alternative scanning methodology, each image portion includes a one dimensional array of pixels. One dimensional scanning is performed for such image portions. FIG. 4 depicts a one dimensional array of vertically-oriented image portions 64. Each image portion 64 is formed by one column of image pixels 66. For an exemplary embodiment having 500 optical channels, there are 500 vertical image portions 64. Each optical channel scans vertically to image each pixel 66 within the corresponding column 64*i*. FIG. 5 depicts a one-dimensional array of horizontal image portions. Each image portion 64 is formed by one row of image pixels 66. For an exemplary embodiment having 500 optical channels, there are 500 horizontal image portions 64. Each optical channel scans horizontally to image each pixel 66 within the corresponding row 64*i*.

FIG. 3 shows an image area 22 formed of multiple subsections 62*a*–62*d*. The number of subsections may vary. For each subsection 62*i,* is formed from a plurality of image portions 64. As described with regard to FIG. 2, each image portion 64 is formed in turn of a two dimensional array of pixels. Alternatively, like in FIG. 4 or FIG. 5 each image portion may be formed of a one dimensional array of image pixels 66. For a two dimensional array of pixels, each image portion 64 is scanned along two axes. For a one dimensional array of pixels, each image portion is scanned along one axis. Once all image portions 64 within a given image subsection 62*i* are scanned, the image portions within another image subsection are scanned. The image subsections 62 are scanned in series using one set of optical channels 20 or in parallel using multiple sets of optical channels, wherein each set of optical channels includes an integral microlens array.

Position Drivers

Figure 7A:
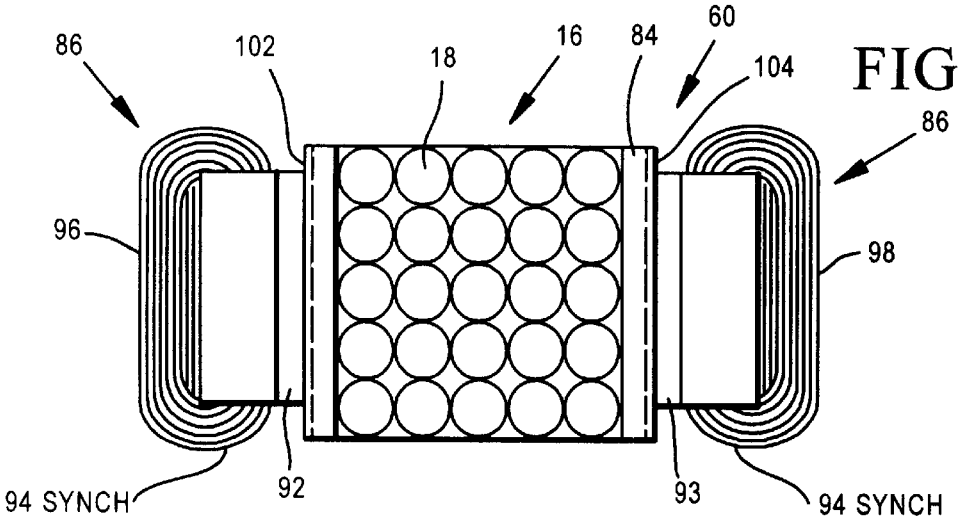
FIGS. 7*a*–7*b* are a top planar view and side planar view of a one axis microlens array position driver of FIG. 1 according to one embodiment of this invention.
Figure 7B:
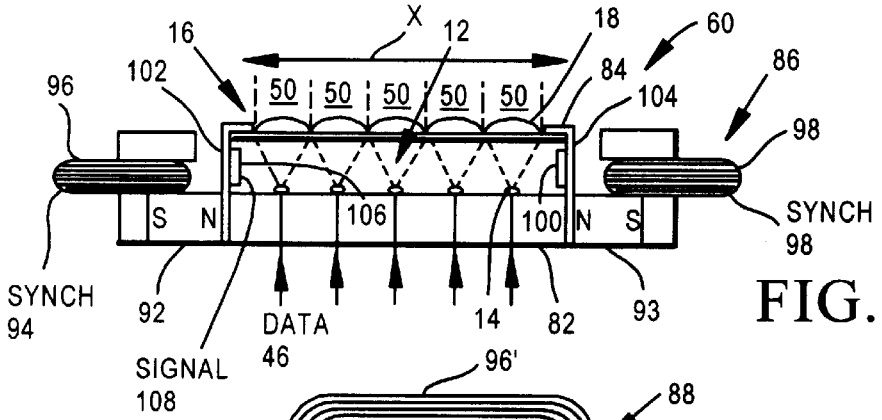
Figure 8:
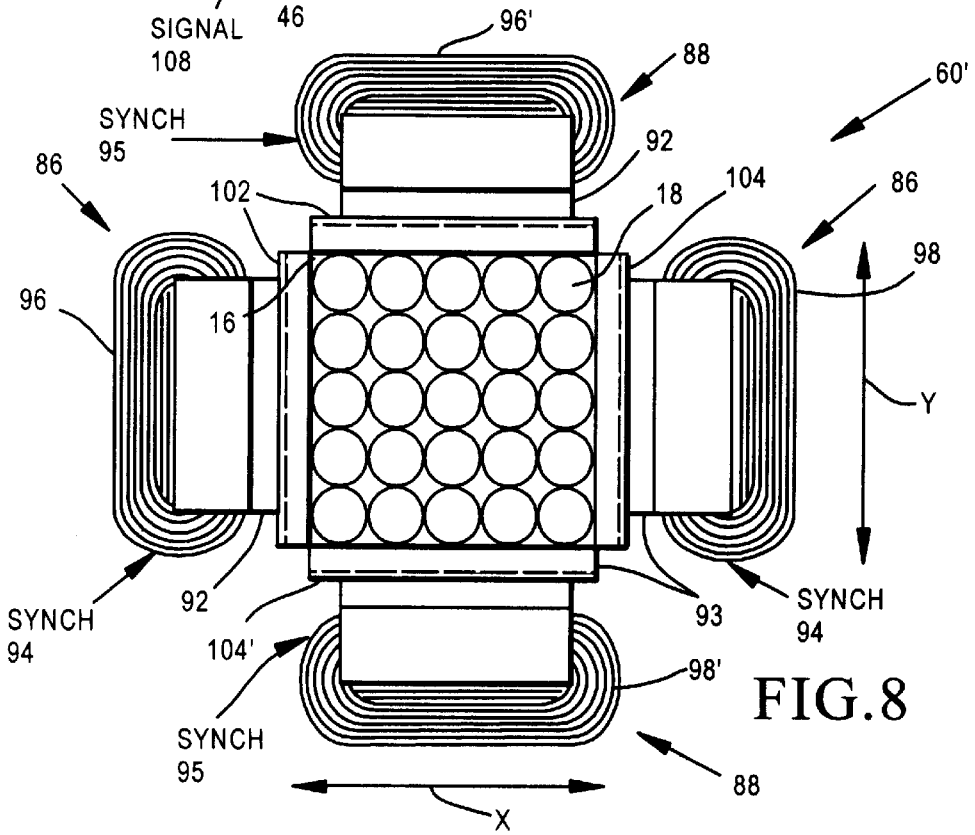
FIG. 8 is a top planar view of a two axis microlens array position driver according to another embodiment of this invention.

Referring to FIGS. 7*a* and 7*b,* the position driver 60 includes a base 82, a frame 84 and at least one drive circuit 86. For one axis scanning one drive circuit 86 is included. FIG. 8 shows an embodiment of the driver 60' having two drive circuits 86, 88—one for scanning along each of two axes. The position drive 60 receives a synchronization signal 94 from the processor 42 to synchronize the scanning of the light beams 50. The position driver 60' receives a pair of synchronization signals 94, 95 from the processor 42. One synchronization signal 94 is for controlling scanning along one axis x, while the other synchronization signal 95 is for controlling scanning along another axis y. Each drive circuit 86, 88 includes a pair of permanent magnets 92, 93 and a pair of electromagnetic coils 96, 98.

The microlens array 16 is mounted to the frame 84 of positioner 60. The frame 84 includes at least two opposing legs 102, 104 protruding from the base 82. The light emitter array 12 is mounted to the base 82. Adjacent to each leg are the permanent magnets 92/94 and the electromagnetic coils 96/98. The synchronization signal 94 is received to energize the coils 96, 98 and generate an alternating magnetic field which deflects the legs 102, 104. The synchronization signal 94 is a periodic signal which drives the coils to induce a magnetic field which moves the legs and thus the microlens array 16 back and forth along a first scanning axis x between a first extreme deflection position and a second extreme deflection position. As a result, the light beams 50 are scanned back and forth along the scanning axis to scan respective lines of pixels 66 within corresponding image portions 64.

For the two-axis driver 60' of FIG. 8 the frame 84 includes at least four opposing legs 102, 104, 102', 104' protruding from the base 82. The light emitter array 12 is mounted to the base 82. Adjacent to each leg is a permanent magnet 92/94, 92'/94' and an electromagnetic coil 96/98, 96'/98'. A first synchronization signal 94 is received to energize the coils 96, 98 and generate an alternating magnetic field which deflects the legs 102, 104. The synchronization signal 94 is a periodic signal which drives the coils 102, 104 to induce a magnetic field which moves the legs and thus the microlens array 16 back and forth along a first scanning axis x between a first extreme deflection position and a second extreme deflection position. The second synchronization signal 95 is received to energize the coils 96', 98' and generate an alternating magnetic field which deflects the legs 102', 104'. The synchronization signal 95 is a periodic signal which drives the coils 96', 98' to induce a magnetic field which moves the legs 102', 104' and thus the microlens array 16 back and forth along a second scanning axis y between a first extreme deflection position and a second extreme deflection position. Note that the first scanning axis x is orthogonal to the second scanning axis y. Thus, the legs 102, 104 are positioned orthogonally to the legs 102', 104'. As a result, the light beams 50 are scanned back and forth along the first scanning axis x and back and forth along the second scanning axis y to scan multiple lines of pixels 66 within corresponding image portions 64.

Piezoelectric sensors 106 are mounted to each leg 102, 104, 102', 104' to detect the position of the microlens array 16 relative to the light emitter array 14. The respective sensor output signals 108, 110 are fed back to the processor 42. In one embodiment, the scanning frequency for scanning along the first axis equals the natural resonant frequency of the moving components of driver 60.

Figure 9A:
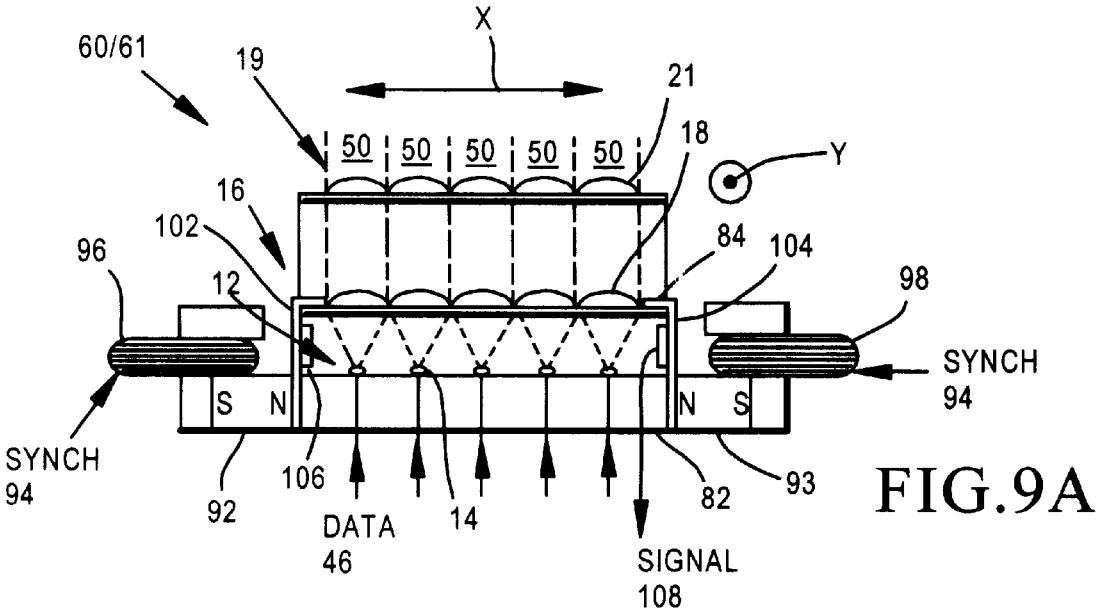
FIGS. 9*a*–9*b* are orthogonal side views of a first axis position driver and second axis position driver of FIG. 1 in a stacked configuration.
Figure 9B:
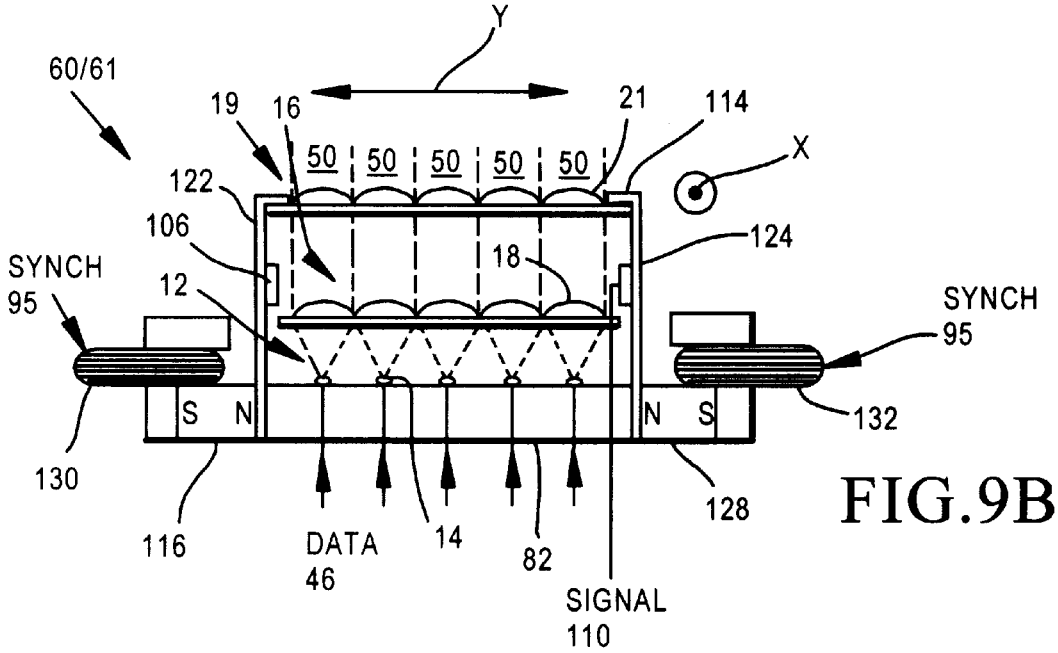

FIGS. 9*a*–9*b* show an embodiment of position driver 60 and position driver 61 operating to scan an image portion 64 along two axes x,y. Position driver 60 scans along one axis x and position driver 61 scans along another axis y. Position driver 60 is formed in the manner described above with respect to FIG. 7. Its deflection path is shown in FIG. 9*a*. Position driver 61 includes similar components and shares a common base 82 with position driver 60. Its deflection path is shown in FIG. 9*b*. Referring to FIG. 9*b*, position driver 61 includes a frame 114 having at least two opposing legs 122, 124 protruding from the base 82. The light emitter array 12 is mounted to the base 82. Adjacent to each leg is a permanent magnet 126/128 and an electromagnetic coil 130/132. The synchronization signal 95 is received to energize the coils 130/132 and generate an alternating magnetic field which deflects the legs 122, 124. The synchronization signal 95 is a periodic signal which drives the coils 130/132 to induce a magnetic field which moves the legs 122, 124 and thus the microlens array 19 back and forth along the second scanning axis y between a first extreme deflection position and a second extreme deflection position. Piezoelectric sensors 106 are mounted to the legs 122, 124 to detect the position of the microlens array 19 relative to the base 82. The piezoelectric sensor output signal 110 is fed back to the processor 42. In a preferred two-axis scanning embodiment, the scanning frequency for scanning along the first axis equals the natural resonant frequency of the moving components of driver 60, and the scanning frequency for scanning along the second axis equals the natural resonant frequency of the moving components of driver 61.

Figure 10:
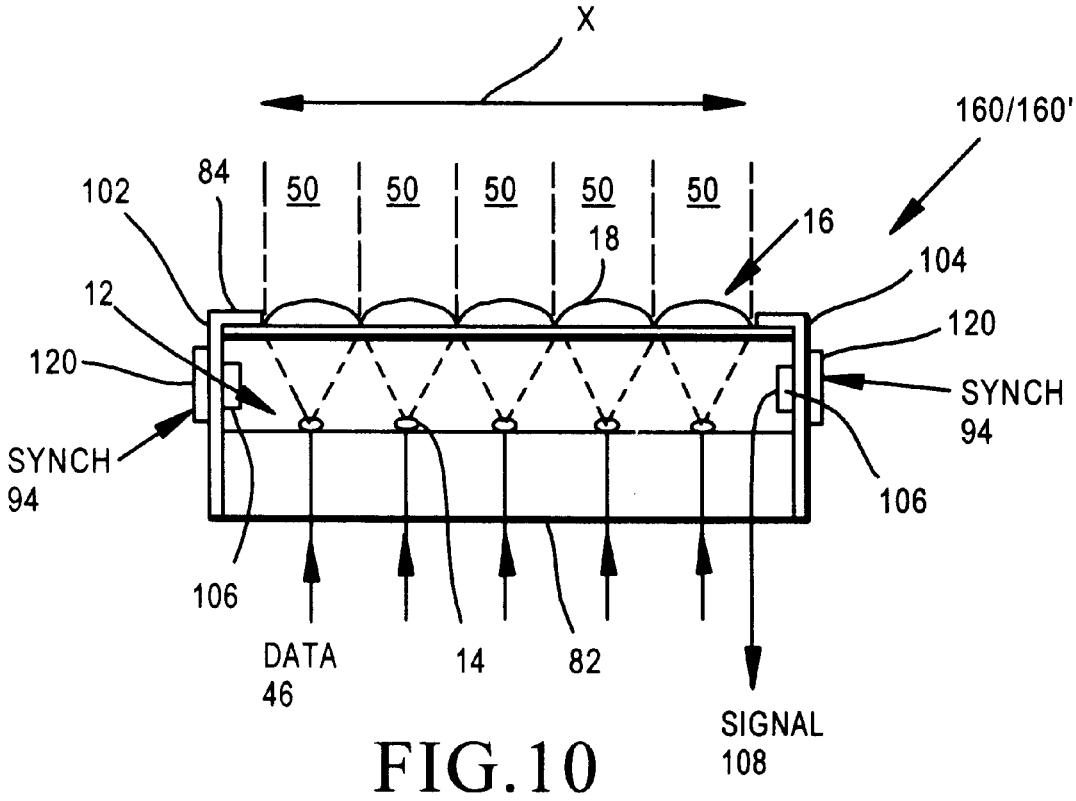
FIG. 10 is a side planar view of a microlens array position driver of FIG. 1 according to another embodiment of this invention.

FIG. 10 shows an alternative embodiment 160 to the one-axis position driver 60 of FIGS. 7*a*–7*b* having a piezoelectric actuator instead of an electromagnetic drive circuit. Each leg 102, 104 includes at least one piezoelectric volume 120 which receives the synchronization signal 94. The synchronization signal is a periodic signal which causes the piezoelectric volumes to deform. Such deformation deflects the legs 102, 104 back and forth along the scanning axis x.

Figure 11:
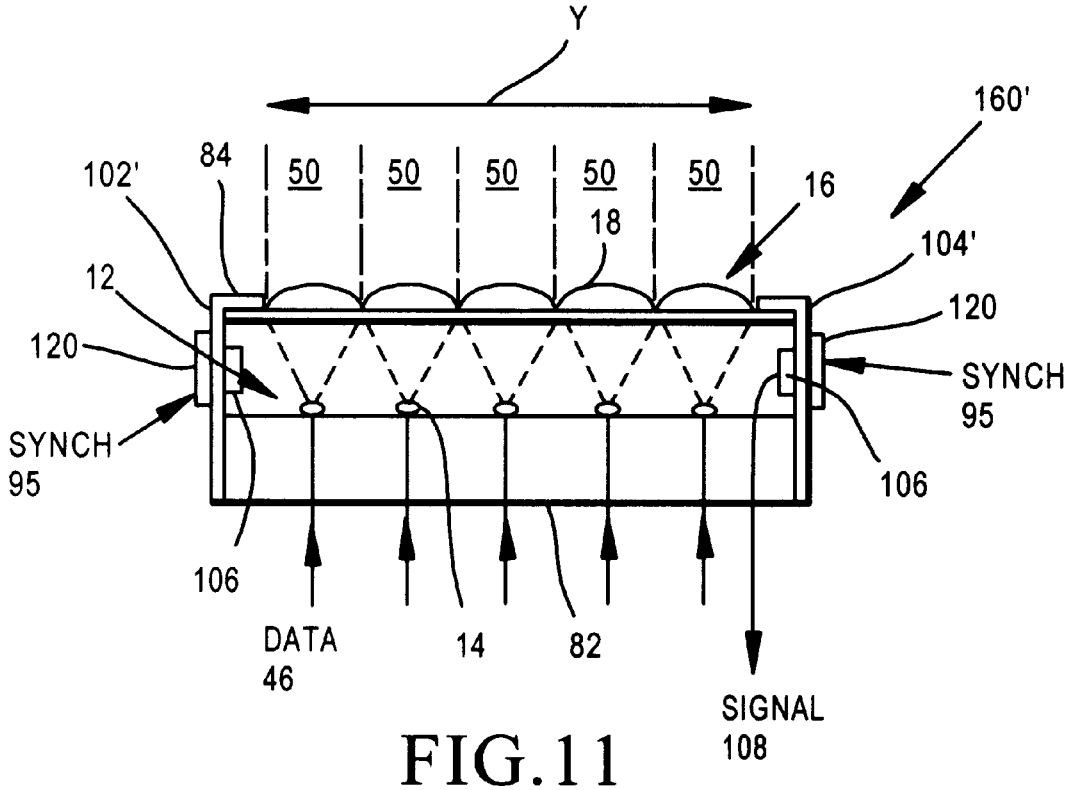
FIG. 11 is a side planar view of a two axis microlens array position driver according to another embodiment of this invention.

FIGS. 10–11 show an alternative embodiment 160' to the two-axis position driver 60' of FIG. 8 having a pair of piezoelectric actuators instead of a pair of electromagnetic drive circuits. FIG. 10 shows the two axis position driver 160' in a view depicting scanning along one axis x. FIG. 11 depicts the driver 160' scanning along the other axis y. Each leg 102, 104, 102', 104' includes at least one piezoelectric volume 120. Legs 102, 104 receive the synchronization signal 94. Legs 102', 104' receive the synchronization signal 95. The synchronization signals 94, 95 are periodic signals which cause the piezoelectric volumes 120 to deform. Such deformation deflects the legs 102, 104 back and forth along the scanning axis x, and the legs 102', 104' back and forth along the scanning axis y. Note that the legs 102, 104 are coupled to the base 82 in a manner allowing the legs 102, 104 free movement along the y axis. The legs 102, 104 are fixed relative to the x axis, but deform to scan the microlens array 16 along such x axis. Similarly, the legs 102', 104' are coupled to the base 82 in a manner allowing the legs 102', 104' free movement along the x axis. The legs 102', 104' are fixed relative to the y axis, but deform to scan the microlens array 16 along such y axis.

Figure 12A:
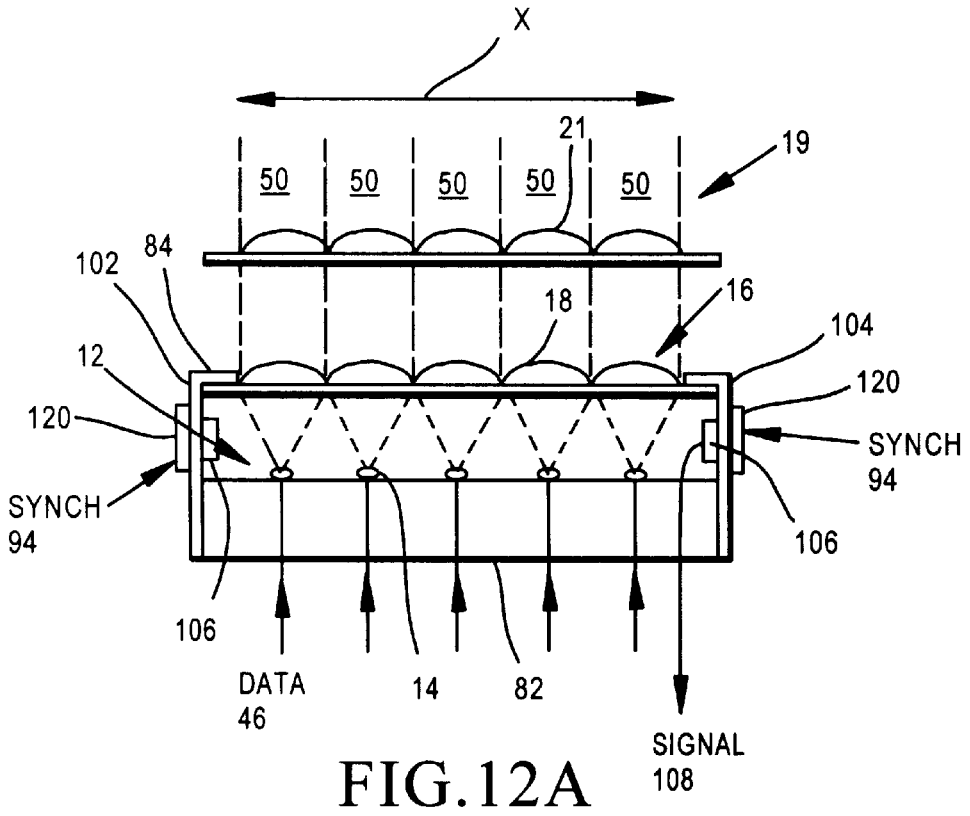
FIGS. 12*a*–12*b* are orthogonal side views of a first axis position driver and second axis position driver of FIG. 1 in a stacked configuration according to another embodiment of this invention.
Figure 12B:
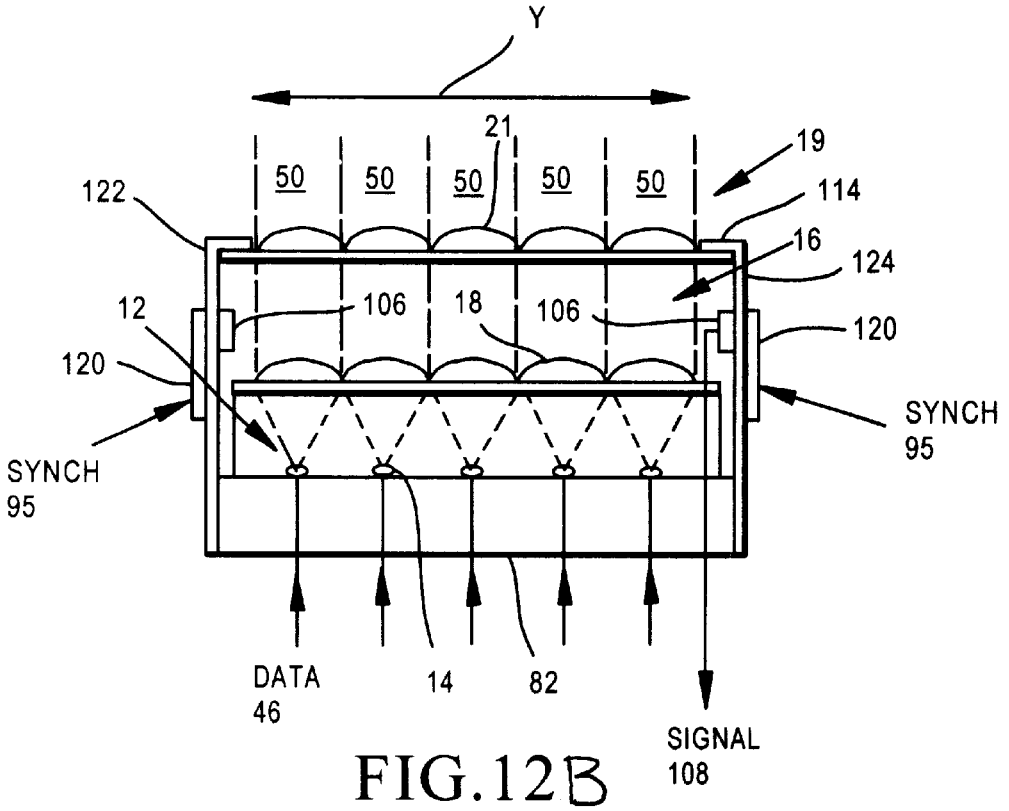

FIGS. 12*a*–12*b* show an alternative embodiment to the stacked position drivers 60, 61 of FIG. 9 having piezoelectric actuators instead of electromagnetic drive circuits. Each leg 102, 104, 122, 124 includes at least one piezoelectric volume 120. Legs 102, 104 receive the synchronization signal 94. Legs 122, 124 receive the synchronization signal 95. The synchronization signals 94, 95 are periodic signals which cause the piezoelectric volumes 120 to deform. Such deformation deflects the legs 102, 104 back and forth along the scanning axis x, and the legs 122, 124 back and forth along the scanning axis y.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A display apparatus for presenting an image, the image including at least one image section made up of a plurality of image portions, each one of the plurality of image portions including a plurality of image pixels, the apparatus comprising:

a plurality of light emitters, each one light emitter being operative to emit a beam of light in response to an input signal;

a microlens array including a plurality of microlenses, each one microlens of the plurality of microlenses corresponding to a respective one light emitter of the plurality of light emitters to receive a corresponding beam of light from said corresponding one light emitter, wherein the microlens array passes a plurality of beams of light, each one of the plurality of passed beams of light corresponding to one microlens, one light emitter and one emitted beam of light, wherein each one microlens of the plurality of microlenses, the corresponding one light emitter and the corresponding emitted, received and passed beam of light together correspond to one image portion of the plurality of image portions within said one image section, the microlens array being movable through a plurality of positions relative to the plurality of light emitters to scan each one of said plurality of passed beams of light to each image pixel of the plurality of image pixels within the corresponding image portion; and a positioner which moves the microlens array relative to the plurality of light emitters in a predetermined pattern in which each one microlens scans the corresponding passed beam of light to each image pixel of the corresponding image portion.

2. A display apparatus for presenting an image, the image including at least one image section made up of a plurality of image portions, each one of the plurality of image portions including a plurality of image pixels, the apparatus comprising:

a plurality of light emitters, each one light emitter being operative to emit a beam of light in response to an input signal;

a microlens array including a plurality of microlenses, each one microlens of the plurality of microlenses corresponding to a respective one light emitter of the plurality of light emitters to receive a corresponding beam of light from said corresponding one light emitter, wherein the microlens array passes a plurality of beams of light, each one of the plurality of passed beams of light corresponding to one microlens, one light emitter and one emitted beam of light, wherein each one microlens of the plurality of microlenses, the corresponding one light emitter and the corresponding emitted, received and passed beam of light together correspond to one image portion of the plurality of image portions within said one image section, the microlens array being movable through a plurality of positions relative to the plurality of light emitters to scan each one of said plurality of passed beams of light to each image pixel of the plurality of image pixels within the corresponding image portion; and a first positioner which moves the microlens array relative to the plurality of light emitters in a predetermined pattern in which each one microlens scans the corresponding passed beam of light to each image pixel of the corresponding image portion;

in which the image includes a plurality of image sections, each one image section of the plurality of image sections comprising a plurality of image portions, and a second positioner which relocates the plurality of light emitters, the microlens array and the first positioner to scan the plurality of image portions of another image section of the plurality of image sections.

3. The display apparatus of claim 1, in which the plurality of light emitters are aligned in a one-dimensional array of light emitters along a first axis, in which the microlens array is a one dimensional array of microlenses aligned along a second axis parallel to the first axis, and in which the plurality of image pixels in said one image portion corresponding to said one light emitter and said one microlens are aligned along a third axis orthogonal to said first axis and said second axis.

4. The display apparatus of claim 1, in which the plurality of light emitters are aligned in a two-dimensional array of light emitters, in which the microlens array is a two dimensional array of microlenses, and in which the plurality of image pixels in said one image portion corresponding to said one light emitter and said one microlens are arranged in a two dimensional array of image pixels.

5. The display apparatus of claim 1, in which the positioner comprises an electromagnetic drive circuit.

6. The display apparatus of claim 1, in which the positioner comprises a piezoelectric drive actuator.

7. The display apparatus of claim 1, in which each one of the plurality of light emitters is directly modulated to define image content.

8. The display apparatus of claim 1, in which each one of the plurality of light emitters is a light emitting diode.

9. The display apparatus of claim 1, in which each one of the plurality of light emitters is an organic light emitter.

10. The display apparatus of claim 1, further comprising an image screen upon which the plurality of passed beams of light are projected to present the image.

11. The display apparatus of claim 1, further comprising an eyepiece through which the plurality of passed beams of light pass to present the image upon a viewer's retina.

12. An apparatus for displaying an image in response to an image signal, the image including at least one image section, said at least one image section including an array of image portions, the apparatus comprising:

an array of modulatable light sources, each one light source of the array of light sources being responsive to a respective drive signal to provide a modulated light beam corresponding to the drive signal;

an integral array of microlenses, each one microlens of the array of microlenses being positioned to receive a modulated light beam from a corresponding one light source; a mechanical positioner coupled to the array of microlenses, the positioner being responsive to a periodic scan signal to move the array through a periodic scan pattern substantially transverse to the modulated light beams; and an electronic controller electrically coupled to the array of modulatable light sources that provides the respective drive signals in response to the image signal, the electronic controller further being electrically coupled to the mechanical positioner and operative to produce the periodic scan signal.

13. The display apparatus of claim 12, in which the positioner comprises an electromagnetic drive circuit.

14. The display apparatus of claim 12, in which the positioner comprises a piezoelectric drive actuator.

15. The display apparatus of claim 12, in which each one of the plurality of light emitters is directly modulated to define image content.

16. The display apparatus of claim 12, in which each one of the plurality of light emitters is a light emitting diode.

17. The display apparatus of claim 12, in which each one of the plurality of light emitters is an organic light emitter.

18. The display apparatus of claim 12, wherein the electronic controller includes:

a central processor; and an electronic memory coupled to the central processor and structured to store data from the image signal.

19. The apparatus of claim 18, wherein the memory is segmented into blocks, each block corresponding to a respective image portion, and wherein the electronic controller further includes an address decoder operative to direct data from the image signal to respective memory blocks.

20. A method of displaying an image, comprising the steps of:

emitting respective first beams of light from a plurality of first locations at a first time;

receiving the first beams to a first set of beam locations within a microlens array;

emitting respective second beams of light from the plurality of first locations at a second time after said first time;

directing the second beams to a second set of beam locations within the microlens array by moving all of the microlenses simultaneously relative to the plurality of first locations.

21. A method for scanning an image, the image including a plurality of image portions, each one image portion of the plurality of image portions including a plurality of image pixels, the method comprising the steps of:

emitting a plurality of beams of light from a plurality of first locations, wherein the plurality of first locations are arranged in a first array;

receiving the plurality of beams of light at an integral array of microlenses, each one microlens passing the received beam of light to generate an image pixel of a corresponding image portion;

moving the microlens array relative to the first array wherein the passed beam of light received at said each one microlens is scanned to generate other image pixels of each corresponding image portion.

22. The method of claim 21, in which the first array is a one dimensional array extending along a first axis, in which the microlens array is a one dimensional array extending along a second axis, and in which the plurality of image pixels in each said one image portion extend along a third axis orthogonal to the first axis and the second axis, and in which the step of moving comprises moving the microlens array relative to the first array along the third axis wherein the passed beam of light received at said each one microlens is scanned to generate said other image pixels of each corresponding image portion.

23. The method of claim 21, in which the first array is a two dimensional array, in which the microlens array is a two dimensional array, and in which the plurality of image pixels in each said one image portion are located within a two dimensional array, and in which the step of moving comprises moving the microlens array relative to the first array along a first scanning axis and a second scanning axis wherein the passed beam of light received at said each one microlens is scanned to generate said other image pixels of each corresponding image portion.

24. A method for scanning an image, the image including a plurality of image portions, each one image portion of the plurality of image portions including a plurality of image pixels, the method comprising the steps of:

emitting a plurality of beams of light from a plurality of first locations, wherein the plurality of first locations are arranged in a first array;

receiving the plurality of beams of light at an integral array of microlenses, each one microlens passing the received beam of light to generate an image pixel of a corresponding image portion;

moving the microlens array relative to the first array wherein the passed beam of light received at said each one microlens is scanned to generate other image pixels of each corresponding image portion, in which the integral array of microlenses is a first microlens array;

receiving the plurality of passed beams of light at an integral second array of microlenses, each one microlens of the second microlens array passing the received beam of light to generate an image pixel of a corresponding image portion; and moving the second microlens array relative to the first array and first microlens array wherein the passed beam of light received at said each one microlens of the second microlens array is scanned to generate other image pixels of each corresponding image portion;

wherein the step of moving the first microlens array scans the light beams along a first axis to generate image pixels within each corresponding image portion along said first axis, and wherein the step of moving the second microlens array scans the light beams along a second axis to generate image pixels within each corresponding image portion along said second axis.

* * * * *